United States Patent [19]

Koski

[11] Patent Number: 4,537,659

[45] Date of Patent: Aug. 27, 1985

[54] SUPPORTING BEAM FOR A FOIL IN A PAPER MACHINE

[75] Inventor: Erkki Koski, Jyväskylä, Finland

[73] Assignee: Valmet Oy, Finland

[21] Appl. No.: 436,403

[22] Filed: Oct. 25, 1982

[30] Foreign Application Priority Data

Oct. 28, 1981 [FI] Finland ..... 813368

[51] Int. Cl.[3] ..... D21C 1/48; D21G 7/00; D21G 9/00

[52] U.S. Cl. ..... 162/352; 162/374; 248/559

[58] Field of Search ..... 162/351, 352, 369, 371, 162/374, 354, 372, 272, 273, 274; 248/559

[56] References Cited

U.S. PATENT DOCUMENTS

| | | | |
|---|---|---|---|
| 2,978,213 | 4/1981 | Kass | 248/559 |
| 3,393,124 | 7/1968 | Kingler et al. | 162/374 |
| 3,535,204 | 10/1970 | Truxa | 162/374 |
| 3,762,991 | 10/1973 | Justus | 162/374 |
| 4,061,532 | 12/1977 | Biondetti | 162/374 |
| 4,162,937 | 7/1979 | Corbellini | 162/374 |
| 4,203,546 | 5/1980 | Raquet et al. | 248/559 |

*Primary Examiner*—Steve Alvo

*Attorney, Agent, or Firm*—Steinberg & Raskin

[57] ABSTRACT

A supporting beam for a paper machine foil or the like is constituted by a horizontal box-type beam, the height of which is in the range of about 1.3 to 2.5 times the breadth of the beam and the side walls of which extend substantially perpendicularly to the run of the paper machine wire which passes over the foil supported by the beam. According to the invention, to reduce the vibrations of the supporting beam, stiffener members are disposed in the rearward upper and forward lower quadrants of the interior of the beam extending parallel to the longitudinal axis thereof. The stiffener members function to incline the principal axes of inertia of the beam at a small positive angle to the vertical and horizontal planes passing through the center of gravity of the beam relative to the direction of run of the paper machine wire. The stiffener members are situated on the inwardly facing surfaces of the vertical side walls of the beam and preferably extend substantially over the entire length of the beam. The stiffener member situated in the rearward upper quadrant is located proximate to the top side wall of the beam and the stiffener member situated in the forward lower quadrant is located close to the lower corner of the beam.

9 Claims, 5 Drawing Figures

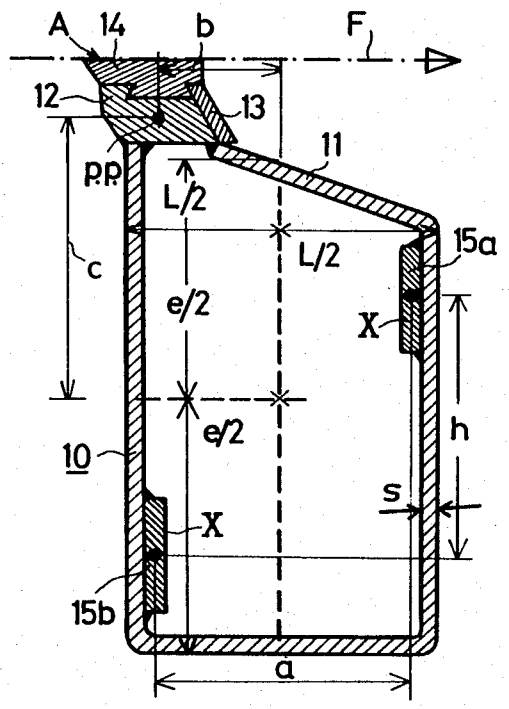
FIG. 2
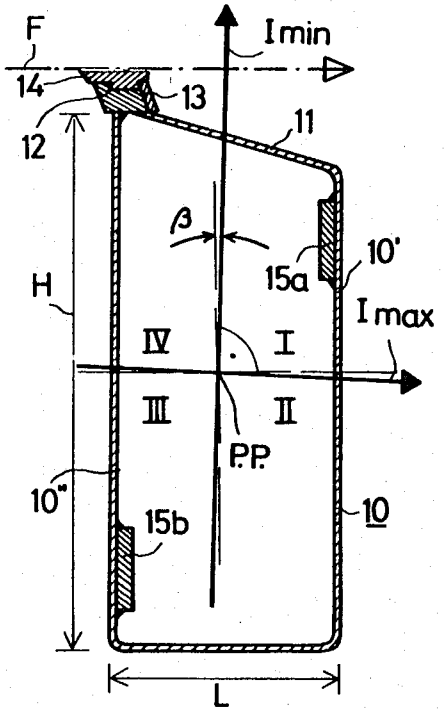
FIG. 1
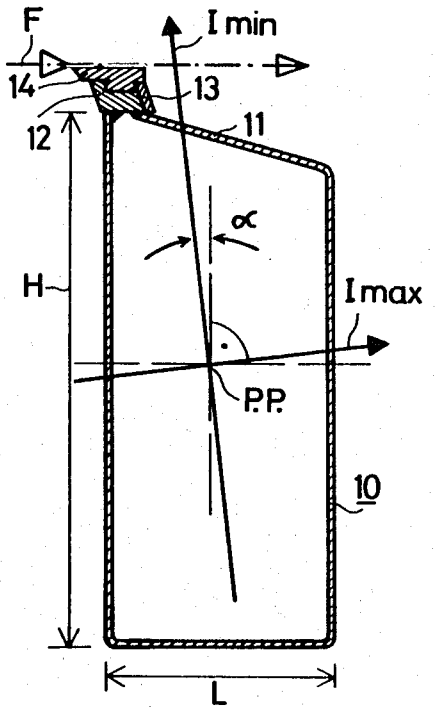
FIG. A
PRIOR ART

FIG. 3
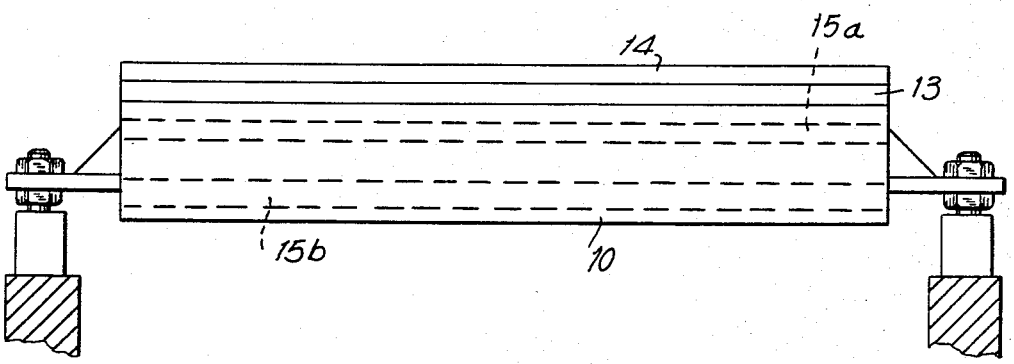
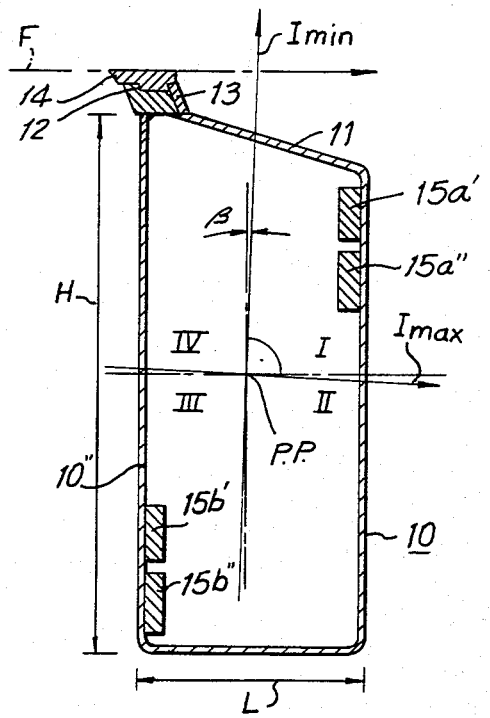
FIG. 4

SUPPORTING BEAM FOR A FOIL IN A PAPER MACHINE

BACKGROUND OF THE INVENTION

The present invention relates generally to paper making machines and, more particularly, to a supporting beam for a paper machine foil or the like, in particular for supporting a so-called single blade foil, the supporting beam being constituted by a horizontal box-type beam having a height dimension of about 1.3 to 2.5 times the breadth of the beam and wherein the side walls of the beam are situated in respective planes which are substantially perpendicular to the direction of travel of the paper machine wire against which the foil supported by the beam rubs.

In the forming sections of conventional paper machines such, for example, as in the Fourdrinier wire section of a paper machine, foils are employed for dewatering the web supported on the wire, such foils being supported on a supporting beam which extends in the cross-machine direction. Box-type beams, i.e., hollow beams having substantially rectangular cross-sections, are often used as such foil supporting means. A box-type beam for supporting a paper machine foil or the like usually has a height of about 1.3 to 2.5 times the horizontal breadth of the beam. A holder device is provided on the upper part of the beam in which the foil list, or blade of the foil, is fixed.

Since the foil supporting beam generally constitutes the most slender or narrowest beam of the entire wire section, such beams are particularly susceptible to vibrations which most often are caused by the friction forces present between the foil and the paper machine wire passing thereover. These vibrations are particularly harmful since they tend to create disturbances in the web formation. Moreover, the vibrations tend to propogate through the frame structure of the wire section so as to set up corresponding vibrations in other pieces of equipment which may cause serious problems in their operation. In fact in extreme cases, the vibrations set up in the foil supporting beam can shatter a ceramic foil list.

Attempts have been made to reduce the vibrations of foil supporting beams by forming the upper part of the beam so as to be inclined in the direction of web travel. In this regard, reference is made to U.S. Pat. No. 3,762,991 assigned to Beloit Corporation of Beloit, Wis. It is stated in this patent that it is favorable to provide the frame of the foil beam such that upon the beam being deflected due to the effect of the horizontal friction force created between the wire and the foil list, that the extent of the beam's deflection is about 0° to 5° in a downwardly slanted direction. It is noted in the patent that by this provision the tendency of the beam to vibrate is reduced. However, the arrangement disclosed in the above-mentioned patent has the drawback that the inclination of the beam necessarily increases the space requirements for the foil in the lateral direction consequently resulting in the fact that fewer foil beams can be accommodated on a given horizontal run of the wire. Another drawback of the arrangement disclosed in this patent is a greater difficulty in the manufacture of such an inclined beam and the fact that the inclined position of the front side wall of the foil beam tends to increase splashing of water back into the paper maching wire.

SUMMARY OF THE INVENTION

Accordingly, the main object of the present invention is to provide a new and improved supporting beam for a paper machine foil or the like wherein the tendency of vibrations being set up in the supporting beam due to the friction forces between the foil and wire passing thereover is significantly decreased relative to conventional foil supporting beams and in which the drawbacks discussed above are avoided.

Briefly, in accordance with the present invention, these and other objects are attained by providing additional stiffener means in the rearward upper and forward lower quadrants of the interior of the beam, which stiffener means function to incline the principal axes of inertia of the beam at a small positive angle to the vertical and horizontal planes passing through the center of gravity of the beam relative to the direction of run of the paper machine wire passing over the foil.

As used herein, the term "positive angle" denotes an angle which is created by inclining or turning the principal axes of inertia of the beam from respective horizontal and vertical planes passing through the center of gravity of the beam in the same direction as the direction of travel of the wire over the foil, i.e., "with the current".

The stiffener means so situated within the respective quadrants extend substantially parallel to the longitudinal axis of the beam.

DESCRIPTION OF THE DRAWINGS

A more complete appreciation of the present invention and many of the attendant advantages thereof will be readily understood by reference to the following detailed description when considered in connection with the accompanying drawings in which:

FIG. A is a side elevation view in section of a conventional foil supporting beam of the prior art;

FIG. 1 is a side elevation view in section of a foil supporting beam in accordance with the present invention;

FIG. 2 is a side elevation view in section of a foil supporting beam in accordance with the present invention and illustrating an example of the dimensioning of the beam;

FIG. 3 is a front elevation view of the foil supporting beam of FIG. 2; and FIG. 4 is a side elevation view in section of a supporting beam in accordance with a second embodiment of the present invention.

DESCRIPTION OF THE PREFERRED EMBODIMENTS

Referring now to the drawings wherein like reference characters designate identical or corresponding parts throughout the several views, and more particularly to FIG. A, a foil beam 10 in accordance with the prior art is constituted by a horizontally extending beam 10 which supports holder members 12 and 13 on its top side wall 11. A foil list 14 such, for example, as a ceramic blade-like list, is attached to the holder members 12 and 13 in a conventional manner. The side walls 10' and 10'' of the foil beam 10 extend in substantially vertical planes so as to be oriented substantially perpendicularly to the plane F of the wire passing over the foil list 14. The side walls 10' and 10'' constitute rearward and forward side walls, respectively, with respect to the direction of the run of the machine wire.

As seen in FIG. A, the principal axes of inertia $I_{max}$ and $I_{min}$ of the beam 10 are inclined at a negative angle $\alpha$ to the vertical and horizontal planes passing through the center of gravity P.P. of the beam 10 relative to the direction of the run of the paper machine wire passing over the foil 14. In other words, the principal axes of inertia of conventional foil supporting beams are positioned at an angle $\alpha$ "against the current" with respect to the direction of travel of the wire F. The principal axes of inertia $I_{max}$ and $I_{min}$ intersect with each other at the center of gravity P.P. of the supporting beam 10.

In a particular conventional foil beam of the type illustrated in FIG. A having a height H of 660 mm and a breadth L of 277 mm and a wall thickness s of 8 mm, the negative angle $\alpha$ is 6° 18'. Since $I_{max}$ is greater than $I_{min}$, the friction force between the wire F and the foil list 14 will cause a deflection whose resultant is directed upwardly at a small angle with respect to the horizontal plane. This deflection tends to increase the friction force between the foil list 14 and the wire F to thereby create a kind of positive or reinforcing feedback coupling with respect to the vibrations produced by the friction forces.

Referring now to FIGS. 1–3, a foil supporting beam 10 in accordance with the present invention is illustrated. The foil beam 10 in accordance with the present invention is similar in design to that described above in connection with FIG. A in that it includes rearward and forward side walls 10' and 10'', a top wall 11, foil holder members 12 and 13 and a foil list 14 held by holder members 12 and 13. The height H of the foil beam 10 is about 1.3 to 2.5 times the breadth L thereof. The rearward and forward walls 10' and 10'' of the foil beam 10 are situated in planes which are substantially perpendicular to the direction of travel of the paper machine wire F which passes over the foil 14 supported by beam 10.

In accordance with the invention, stiffener members **15*a* and 15*b* are affixed to the inwardly facing surfaces of vertical side walls 10' and 10'' respectively of the foil beam 10. More specifically, the interior of the foil supporting beam 10 can be divided into 4 quadrants, namely upper and lower rearward quadrants I and II and lower and upper forward quadrants III and IV. The first stiffener member 15*a* is located in the rearward upper quadrant I of the foil beam 10 affixed to the inner surface of the rearward wall 10' while the second stiffener member 15*b* is located in the forward lower quadrant III of beam 10 on the inwardly facing surface of the front wall 10''. The stiffener members 15*a* and 15*b* located in the manner described above cause the principal axes of inertia $I_{max}$ and $I_{min}$ of the beam 10 to be inclined at a small positive angle $\beta$, i.e., "with the current", to the vertical and horizontal planes passing through the center of gravity P.P. of beam 10 relative to the direction of the run of the paper machine wire passing over the foil 14**.

Thus, the stiffener members **15*a* and 15*b* constitute first and second stiffener means extending substantially parallel to the longitudinal axis of beam 10 with the first stiffener means 15*a* being disposed in the rearward upper quadrant I of the beam interior and with the second stiffener means 15*b*** being disposed in the forward lower quadrant III of the beam interior.

By turning or inclining the principal axes of inertia $I_{max}$ and $I_{min}$ so that the same form a small positive angle relative to the vertical and horizontal planes passing through the center of gravity of the beam, i.e., so that these axes extend in the direction of the web or wire travel, a type of negative or reducing feedback is obtained regarding the vibrations arising from the friction forces created between the wire F and the foil 14. The beam 10 in accordance with the invention will vibrate mainly in a horizontal plane since the initiating stimulus from the friction forces is likewise substantially horizontal. However, the direction imparted to the principal axes of inertia $I_{max}$ and $I_{min}$ through the provision of the stiffener means in accordance with the invention results in the beam, while vibrating in its horizontal plane, being only slightly deflected in a downward direction whereby the friction forces between the wire F and the foil 14 are reduced. In this manner, an effect resembling a negative or reducing feedback will act to counteract the stimulus which initiates the vibrations. Additionally, an increased vibration damping effect is obtained due to the inherent increase in friction damping provided by the welded connections between the stiffener members and the side walls of the beam.

In the illustrated preferred embodiment, the stiffener members **15*a* and 15*b* are affixed to the inwardly facing surfaces of the side walls 10' and 10'' of beam 10 by either a continuous or interrupted weld or welds. The stiffener members 15*a* and 15*b* preferably have a rectangular cross-section so that the broad side of each stiffener member is situated against the inwardly facing surface of a respective side wall of the beam 10. The thickness of the stiffener members 15*a* and 15*b* is preferably about 2 to 4 times the wall thickness s of the beam 10. The height of each of the stiffener members 15*a* and 15*b* is preferably about 3 to 7 times their thickness. The stiffener members 15*a* and 15*b* also preferably extend substantially over the entire length of the beam 10** in the horizontal direction.

It is also possible to employ in lieu of each stiffener member **15*a* and 15*b* several separate stiffener members affixed to a respective side wall in the same region thereof so as to be mutually spaced from each other by small vertical distances. Thus, referring to FIG. 4, pairs of stiffener members 15*a'*, 15*a''* and 15*b'*, 15*b''* are affixed to rear and front walls 10' and 10'' of beam 10 in the rearward upper and forward lower quadrants respectively. The stiffener members 15*a* and 15*b*** may also be constituted by corresponding box-type beams.

Referring to FIGS. 2, a typical example of the various dimensions of a beam 10 in accordance with the invention will now be described. Referring to the symbols illustrated in FIG. 2, the following approximate formula may be derived:

$$X = n \cdot b \cdot c \cdot G / a \cdot h$$

where X is the cross-sectional area of one of the stiffener members **15*a* and 15*b*, G is the cross-sectional area of the foil holder member 12** which is integrally attached to the foil beam, n is a coefficient which is between 2.8 and *3.3*, b is the horizontal distance between the center of gravity p.p. of holder member 12 and the center of gravity of the beam 10, c is the vertical distance between the center of gravity p.p. of the holder member 12 and the center of gravity of the beam 10, a is the horizontal distance between the centers of gravity of stiffener members **15*a* and 15*b* and h is the vertical distance between the centers of gravity of the stiffener members 15*a* and 15*b*. The preliminary dimensions of the stiffener members 15*a* and 15*b*** can be calculated using the above formula whereupon the direction of the axes of inertia $I_{max}$ and $I_{min}$ may then be calculated with greater accuracy by known formulas or by appropriate computer programs.

A typical example of dimensions for a foil supporting beam illustrated in FIGS. 2 is set forth below:

$a=241$ mm
$h=410$ mm
$X=20 \cdot 100=2000$ mm$^2$
$G=1568$ mm$^2$
$b=123$ mm
$c=360$ mm
$n=2.85$ The angle $\beta$ can then be derived by calculation to be 1°36′.

It is seen from the foregoing that through the appropriate use of stiffener member 15*a* and 15*b* in accordance with the invention, an efficient arrangement is achieved whereby vibrations of the foil beam 10 can be significantly reduced.

It should be understood that the stiffener members 15*a* and 15*b* may constitute additional stiffeners to those already present in a foil supporting beam. In such case, the stiffener members thus comprise additional stiffener members which act to incline the principal axes of inertia of the beam in the manner described above.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In an assembly including a paper machine foil having a forward leading edge and a rearward trailing edge, a supporting beam for said paper machine foil, and over which foil a paper machine wire passes in a direction from said forward leading edge of said foil towards said rearward trailing edge thereof, said beam being constituted by a box-type beam extending in a substantially horizontal cross-machine direction during operation and having a height H in the range of about 1.3 to 2.5 times the breadth L of said beam, said beam having forward and rearward side walls, the improvement comprising the combination wherein:

said forward and rearward side walls of said supporting beam are situated in planes which are substantially perpendicular to the direction of wire run over said foil;

said foil is situated in a region situated substantially vertically above said forward side wall of said supporting beam; and with reference to forward and rearward upper quadrants and forward and rearward lower quadrants of the interior of said box-type beam, first and second stiffener means extending substantially parallel to the longitudinal axis of said beam for inclining the principal axes of inertia of said beam at a small positive angle to the vertical and horizontal planes passing through the center of gravity of said beam relative to the direction of the run of the paper machine wire passing over said foil, said first stiffener means being disposed in said rearward upper quadrant of the beam interior and said second stiffener means being disposed in said forward lower quadrant of the beam interior, whereby vibrations of said beam caused by friction forces between said foil and the wire passing thereover are reduced.

2. The combination of claim 1 wherein said first stiffener means is situated on the inwardly facing surface of said rear side wall and said second stiffener means is situated on the inwardly facing surface of said front side wall, and wherein said first and second stiffener means extend substantially over the entire axial length of said beam.

3. The combination of claim 1 wherein said first stiffener means disposed in said rearward upper quadrant of the beam interior is situated proximate to a top side wall of said beam and wherein said second stiffener means disposed in said forward lower quadrant of the beam interior is situated proximate to a lower corner of said beam.

4. The combination of claim 1 wherein said first and second stiffener means are situated and dimensioned such that said small positive angle at which the principal axes of inertia of said beam are inclined with respect to said vertical and horizontal planes is in the range of about 1° to 2°.

5. The combination of claim 1 wherein each of said first and second stiffener means include at least one stiffener member.

6. The combination of claim 5 wherein each stiffener member has a height dimension which is several times the dimension of its thickness.

7. The combination of claim 5 wherein each stiffener member is constituted by a solid beam having a substantially rectangular cross-section.

8. The combination of claim 5 wherein each of said first and second stiffener means include two or more beam members spaced from each other by a small vertical distance.

9. The combination of claim 5 wherein each of said first and second stiffener means include at least two beams situated in side-by-side relationship.

* * * * *